United States Patent [19]

Lafata

[11] Patent Number: 4,615,489

[45] Date of Patent: Oct. 7, 1986

[54] PROCESS AND APPARATUS FOR THE PREPARATION OF A MIX COMPOSED OF MINERAL FIBERS AND INORGANIC HYDRAULIC BINDERS

[75] Inventor: Ange Lafata, Grenoble, France

[73] Assignee: Projiso, Eybens, France

[21] Appl. No.: 682,318

[22] Filed: Dec. 17, 1984

[30] Foreign Application Priority Data

Dec. 22, 1983 [FR] France ..... 83 20609

[51] Int. Cl.[4] ..... B02C 19/12

[52] U.S. Cl. ..... 241/4; 241/101 B; 366/16

[58] Field of Search ..... 366/20, 64, 318; 241/4, 241/101 B, 21, 22, 28, 101 A, 277, 280, 281, 282

[56] References Cited

U.S. PATENT DOCUMENTS 4,022,439 5/1977 Groth .
4,023,779 5/1977 Beloy .
4,175,867 11/1979 Piazza ..... 366/9
4,347,985 9/1982 Simpson ..... 241/4 X
4,366,927 1/1983 Kielmeyer ..... 241/4

FOREIGN PATENT DOCUMENTS 2304591 10/1976 France .
2503618 10/1976 France .

*Primary Examiner*—Mark Rosenbaum
*Attorney, Agent, or Firm*—Owen, Wickersham & Erickson

[57] ABSTRACT

Process and apparatus for the preparation of a mix composed of mineral fibers and of inorganic hydraulic binders in particle or liquid form. A bale of fibers is continuously defibrated. The fibers are continuously conveyed to the input end of a screw type conveyor-mixer. Binders are continuously added to the fibers during their travel. The resulting mix is discharged at the outlet end of the screw type conveyor-mixer.

11 Claims, 3 Drawing Figures

PROCESS AND APPARATUS FOR THE PREPARATION OF A MIX COMPOSED OF MINERAL FIBERS AND INORGANIC HYDRAULIC BINDERS

The present invention relates to a process for the preparation of a mix composed of mineral fibers and inorganic hydraulic binders in particle or liquid form.

Mixes of this kind, usually composed of slag wool or volcanic rock wool, cement and silicate in particle form and of oil, are generally intended for application, after the addition of water, by projection onto a surface in order to form a coating having thermal and acoustic insulating and fire arresting properties.

At the present time, for the preparation of a mix of this kind a determined amount of mineral fibers, a determined amount of cement, a determined amount of silicate and a determined amount of oil are introduced into a drum. This drum is rotated for a period of time deemed necessary for obtaining the desired mix, and the mix obtained is discharged. In order to prepare a further amount of the mix, these operations are repeated. It follows that this process, of a repetitive or sequential type, does not make it possible to obtain high outputs, so that the cost of preparing such a mix is relatively high.

The present invention seeks to obviate the disadvantages of the prior art, and proposes firstly a process for the preparation of a mixture composed of mineral fibers and inorganic hydraulic binders in particle or liquid form, consisting in continuously defibrating a bale of fibers, continuously conveying the fibers to the inlet of a screw type conveyor-mixer, continuously adding the binders to the fibers during their travel, and discharging the resulting mix at the outlet of ther screw type conveyor-mixer.

The process according to the present invention also consists in incorporating in the fibers, during their travel, for example cement and silicate.

The process according to the present invention consists in addition in incorporating in the fibers, during their travel in the screw type conveyor-mixer, for example oil.

The present invention also relates to an apparatus for the preparation of a mix composed of mineral fibers and of inorganic hydrdaulic binders in particle or liquid form for the application of the process described above. This apparatus comprises means for supporting at least one bale of fibers, means for continuously defibrating this bale, means for continuously conveying the fibers to the inlet of a screw type conveyor-mixer, means for continuously adding the binders to the fibers during their travel, and means for discharging the resulting mix at the outlet of the screw type conveyor-mixer.

According to the present invention, the said support means for the bale of fibers is preferably in the the form of a belt conveyor, the means for defibrating the bale being in the form of at least one toothed roll to which the belt conveyor carries the bale of fibers.

According to the present invention, the said means for carrying the fibers to the inlet of the screw type conveyor-mixer preferably comprises at least one belt conveyor.

According to the present invention, the said means for adding the binders in particle form preferably comprises a tank for the binder and a screw type conveyor for continuously supplying and pouring this binder onto the path of the fibers.

According to the present invention, a series of nozzles enabling the oil to be sprayed onto the fibers in the screw type conveyor-mixer may be provided.

The present invention will be better understood on study of an apparatus for the preparation of a mix composed of mineral fibers, cement and a silicate in particle form and of oil, which is described as a non-limitative example and illustrated in the accompanying drawings, in which.

Figure 1:
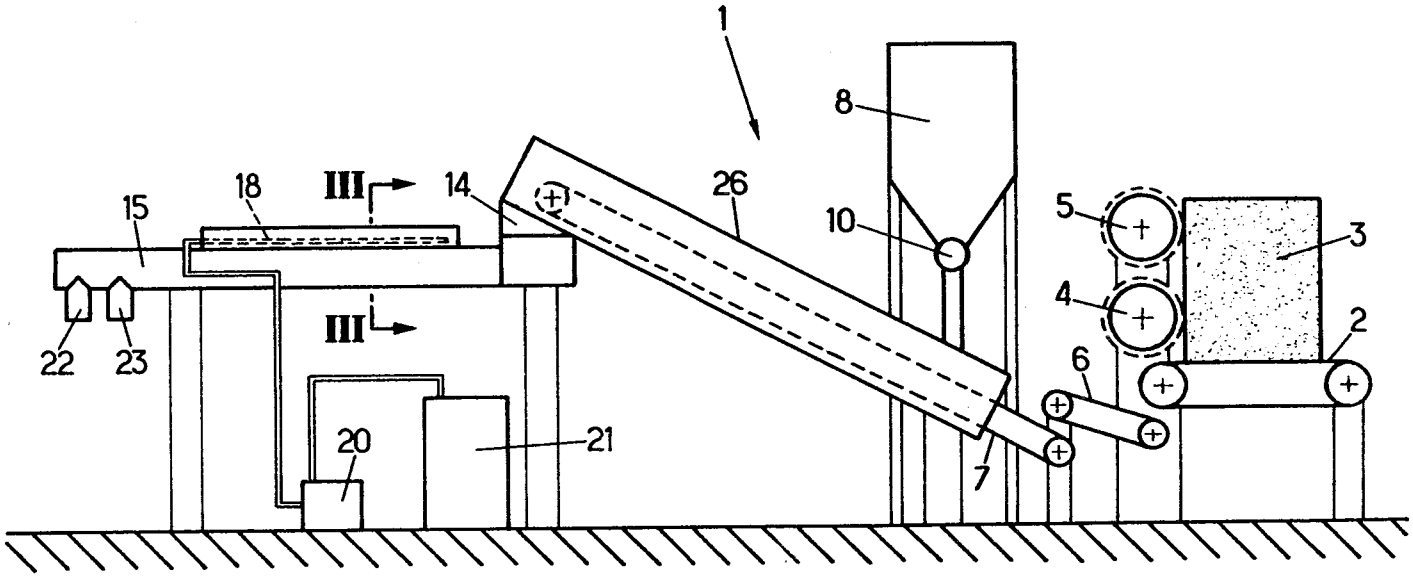
FIG. 1 is a view in elevation of the preparation chain.

The apparatus shown in the drawings and given the general reference 1 comprises a horizontal belt conveyor 2, on which is disposed a bale 3 of mineral fibers, such as slag wool or volcanic rock wool, and also two horizontal rolls 4 and 5 disposed one above the other. On their periphery the rolls 4 and 5 are provided with teeth which enable the bale 3 to be regularly and continuously defibrated when it is moved by the horizontal conveyor 5 in their direction.

At the end of the horizontal conveyor 2 the fibers coming continuously from the bale 3 are poured onto a belt conveyor 6 which continuously carries the fibers to the bottom part of an inclined belt conveyor 7.

Figures 2, 3:
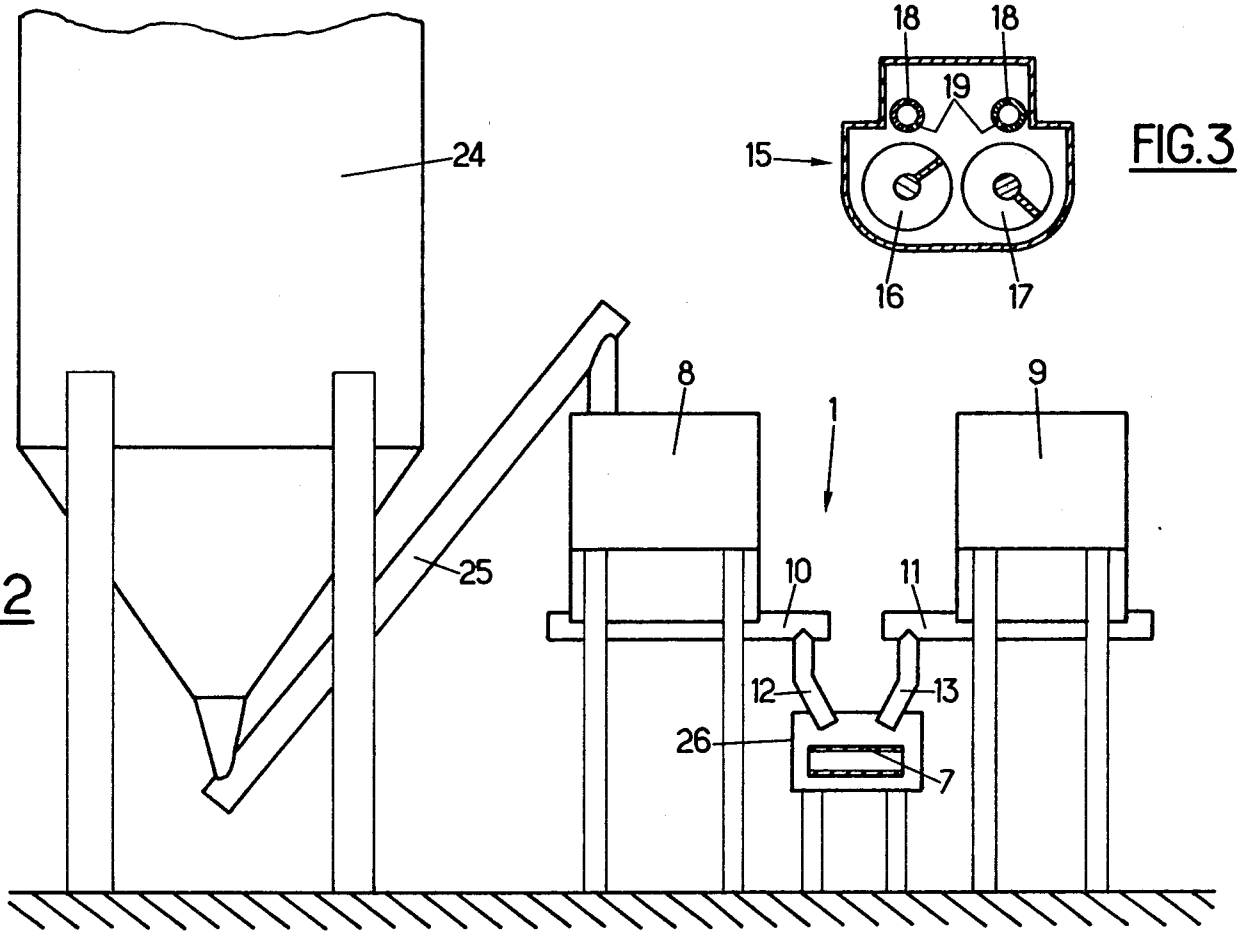
FIG. 2 is a transverse view in elevation of the apparatus shown in FIG. 1.
FIG. 3 is a section of the line III—III of the apparatus shown in FIG. 1.

Referring to FIG. 2, it is seen that on the two sides of the belt conveyor 7 there are provided on the one hand a tank 8 holding cement particles and a tank 9 holding silicate particles, these tanks being provided at their bases with conveying the metering screws 10 and 11 whose oulet pipes 12 and 13 discharge above the belt conveyor 7 in such a manner as to pour onto the latter a metered amount of cement and silicate.

As can be seen in FIG. 1, the belt conveyor 7 continuously pours the fibers, with the cement and silicate added thereto, into an inlet hopper 14 of a horizontally disposed screw type conveyor-mixer 15.

As can be seen in FIG. 3, the screw type conveyor-mixer 15 has two parallel screws 16 and 17. The top space of the screw type conveyor-mixer 15 contains a horizontal extending pipe 18 provided with a series of nozzles 19 directed towards the space situated between the screws 16 and 17. This pipe 18 is intended for the atomization of oil pumped by a pump 21 from a tank 20.

In the course of their travel the mineral fibers, the cement and the silicate and the oil are mixed in the screw type conveyor-mixer 15.

At its opposite end to the hopper 14, the screw type conveyor-mixer 15 has two downwardly directed pipes 22 and 23, which enable the mix obtained to be poured, for example, into sacks. Dust suction means (not shown) may in addition be provided on these pipes 22 and 23.

It can be seen in FIG. 2 that a tank 24 of large dimensions has also been provided for the cement, a screw elevator 25 enabling the cement to be continuously conveyed from the bottom of the tank 24 to the cement tank 8.

The apparatus 1 shown in the drawings and described above makes it possible to obtain or prepare the desired mix continuously. In fact, by adjusting the speed of movement of the conveyor 2 and the speed of the defibrating rolls 4 and 5, and by adjusting the speed of rotation of the conveying and metering screws 10 and 11, the desired amount of fibers, the desired amount of cement, and the desired amount of silicate are brought to the inlet end 14 of the screw type conveyor-mixer 15 by means of the belt conveyors 6 and 7. By regulating the pump 21, the desired amount of oil is atomised by means of the nozzles 19. It is obvious that the length of the screw type conveyor-mixer 15 is suitable for obtaining a substantially homogeneous mix at its outlets 22 and 23, the abovementioned amounts taking into account the length of the screw type conveyor-mixer 15.

Referring to FIGS. 1 and 2, it can be seen that the different elements constituting the apparatus 1 are carried by posts and that the belt conveyor 7 is surrounded by a casing 26 over a large part of its length. The bottom part of the belt conveyor 7, the belt conveyor 6 and the assembly comprising the belt conveyor 2 and the defibrating rolls 4 and 5 could obviously also be enclosed in a casing.

The present invention is not restricted to the example described above. Many alternative arrangements are possible without departing from the scope defined by the accompanying claims.

I claim:

1. A process for the preparation of a mix composed of mineral fibers and inorganic hydraulic binders in particles, comprising: continuously defibrating in metered amounts a bale of fibers by displacing substantially horizontally the bale in the direction of at least one rotating toothed roll which continuously defibrates the bale, conveying at a determined speed the fibers coming continuously from the bale of fibers to the inlet of a screw type conveyor-mixer, continuously adding in metered amounts the binders to the fibers continuously traveling towards the inlet end of the screw type conveyor-mixer, so as to supply the screw type conveyor-mixer with all the mineral fibers and inorganic binders in particles of the desired mixture, and rotating at a determined speed the screw of the screw type conveyor-mixer in such a manner as to displace and mix continuously the fibers and the binders and to discharge continuously at the outlet end of the screw type conveyor-mixer a substantially homogeneous mixture of fibers and binders.

2. A process as claimed in claim 1, which includes adding cement and silicate ahead of said inlet end incorporating the cement and silicate in the fibers as the mixture travels within the screw type conveyor-mixer.

3. A process as claimed in claim 1, which includes incorporating oil in the fibers as they travel in the screw type conveyor-mixer.

4. An apparatus for the preparation of a mixture composed of mineral fibers and inorganic hydraulic binders in particle or liquid form, which comprises means (2) for supporting and continuously displacing substantially horizontally at least one bale (3) of fibers to at least one toothed roll (4) which defibrates continuously this bale of fibers in metered amounts, means (6, 7) for continuously conveying at a determined speed the fibers, means (10, 11) for continuously adding in metered amounts the binders to the fibers conveyed by the conveying means (6, 7), and a screw type conveyor-mixer (15) fed at its input end by the conveying means (6, 7) with all the fibers and binders of the desired mixture, at the outlet end of which conveyor-mixer a substantially homogeneous mixture of fibers and binders can be discharged.

5. An apparatus as claimed in claim 4, wherein the said support means for the bale of fibers is in the form of a belt conveyor (2) which carries the bale of fibers (3) towards said toothed roll (4).

6. An apparatus as claimed in claim 5 wherein the said means for conveying the fibers and the binders to the input of the screw type conveyor-mixer (15) comprises at least one belt conveyor (6, 7).

7. An apparatus as claimed in claim 5 wherein the said means for adding the binders in particle form to the fibers comprising a tank (8, 9) and a screw conveyor (10, 11) for continuously feeding and pouring this binder in metered amounts onto the path of the fibers.

8. An apparatus as claimed in one of claim 4, wherein the said means for conveying the fibers and the binders to the input of the screw type conveyor-mixer (15) comprises at least one belt conveyor (6, 7).

9. An apparatus as claimed in claim 8 wherein the said means for adding the binders in particle form to the fibers comprising a tank (8, 9) and a screw conveyor (10, 11) for continuously feeding and pouring this binder in metered amounts onto the path of the fibers.

10. An apparatus as claimed in claim 4 wherein the said means for adding the binders in particle form to the fibers comprises a tank (8, 9) and a screw conveyor (10, 11) for continuously feeding and pouring this binder in metered amounts onto the path of the fibers.

11. An apparatus as claimed in any one of claims 4 to 10, which comprises a series of nozzles (19) making it possible to atomize oil into the screw type conveyor-mixer (15).

* * * * *